US006509686B1

(12) United States Patent
Moradi et al.

(10) Patent No.: US 6,509,686 B1
(45) Date of Patent: Jan. 21, 2003

(54) FIELD EMISSION DISPLAY CATHODE ASSEMBLY WITH GATE BUFFER LAYER

(75) Inventors: Behnam Moradi, Boise, ID (US); Kanwal K. Raina, Boise, ID (US); Michael J. Westphal, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/398,155

(22) Filed: Sep. 16, 1999

Related U.S. Application Data

(62) Division of application No. 08/775,964, filed on Jan. 3, 1997, now Pat. No. 6,015,323.

(51) Int. Cl.[7] ..... H01J 1/304; H01J 19/24

(52) U.S. Cl. ..... 313/495; 313/309; 313/336; 313/351

(58) Field of Search ..... 313/495, 496, 313/497, 336, 351, 309, 311, 310, 542; 216/24

(56) References Cited

U.S. PATENT DOCUMENTS

| | | | | | |
|---|---|---|---|---|---|
| 3,671,798 | A | | 6/1972 | Lees | 313/336 |
| 3,970,887 | A | | 7/1976 | Smith et al. | 313/309 |
| 4,940,916 | A | | 7/1990 | Borel et al. | 313/306 |
| 5,151,061 | A | | 9/1992 | Sandhu | 445/24 |
| 5,151,168 | A | | 9/1992 | Gilton et al. | 205/123 |
| 5,162,704 | A | | 11/1992 | Kobori et al. | 315/349 |
| 5,186,670 | A | | 2/1993 | Doan et al. | 445/24 |
| 5,212,426 | A | | 5/1993 | Kane | 315/169.1 |
| 5,229,331 | A | | 7/1993 | Doan et al. | 445/24 |
| 5,259,799 | A | | 11/1993 | Doan et al. | 445/24 |
| 5,283,500 | A | | 2/1994 | Kochanski | 315/58 |
| 5,299,331 | A | | 4/1994 | Badillo | 5/417 |
| 5,319,279 | A | * | 6/1994 | Watanabe et al. | 313/309 |
| 5,359,256 | A | | 10/1994 | Gray | 313/169 |
| 5,372,973 | A | | 12/1994 | Doan et al. | 437/228 |
| 5,601,466 | A | | 2/1997 | Shen et al. | 445/24 |
| 5,631,519 | A | * | 5/1997 | Kim | 313/336 |
| 5,684,360 | A | * | 11/1997 | Baum et al. | 313/542 |
| 5,696,028 | A | * | 12/1997 | Rolfson et al. | 445/24 |
| 5,772,904 | A | * | 6/1998 | Kim | 216/24 |
| 6,010,918 | A | * | 1/2000 | Marino et al. | 313/309 |
| 6,075,315 | A | * | 6/2000 | Seko et al. | 313/336 |
| 6,144,144 | A | * | 11/2000 | Cleeves et al. | 313/309 |
| 6,181,060 | B1 | * | 1/2001 | Rolfson | 313/495 |

* cited by examiner

*Primary Examiner*—Michael H. Day
(74) *Attorney, Agent, or Firm*—Hale and Dorr LLP

(57) ABSTRACT

Improved field emission display includes a buffer layer of copper, aluminum, silicon nitride or doped or undoped amorphous, poly, or microcrystalline silicon located between a chromium gate electrode and associated dielectric layer in a cathode assembly. The buffer layer substantially reduces or eliminates the occurrence of an adverse chemical reaction between the chromium gate electrode and dielectric layer.

16 Claims, 11 Drawing Sheets

PROCESS CONDITIONS OF THE PECVD LAYERS

| LAYER IDENTIFICATION AS PER FIG. 9 | MATERIAL | PROCESS PARAMETERS | | |
|---|---|---|---|---|
| | | POWER (WATTS) | PRESSURE (mTorr) | GAS FLOW (SCCM) |
| 46 (RESISTOR LAYER) | AMORPHOUS SILICON B-DOPED (a-Si-B) | 300 | 1000 | SILANE ($SiH_4$) = 800<br>DIBORANE ($B_2H_6$) = 2 |
| 48 (TIP LAYER) | AMORPHOUS SILICON P-DOPED (a-Si-P) | 500 | 1000 | SILANE ($SiH_4$) = 500<br>PHOSPHINE ($PH_3$) = 5 |
| 50 (DIELECTRIC LAYER) | SILICON DIOXIDE ($SiO_2$) | 900 | 1000 | SILANE ($SiH_4$) = 100<br>NITROUS OXIDE ($N_2O$) = 2000<br>NITROGEN ($N_2$) = 900 |
| 52 (BUFFER) | MICROCRYSTALLINE SILICON (μ C-Si) | 700 | 500 | SILANE ($SiH_4$) = 100<br>HYROGEN ($H_2$) = 1900 |
| | OR AMORPHUS SILICON P-DOPED (a-Si-P) | 500 | 1000 | SILANE ($SiH_4$) = 500<br>PHOSPHINE ($PH_3$) = 5 |
| | OR SILICON NITRIDE ($Si_3N_4$) | 500 | 1000 | SILANE ($SiH_4$) = 100<br>AMMONIA ($NH_3$) = 450<br>HYROGEN ($H_2$) = 900<br>NITROGEN ($N_2$) = 450 |

DEPOSITION TEMPERATURE = 300° C; RF FREQUENCY = 13.75 MHz

FIG. 10a

PROCESS CONDITIONS OF DC MAGNETRON SPUTTERING

| LAYER IDENTIFICATION AS PER FIG. 9 | MATERIAL | PROCESS PARAMETERS | | |
|---|---|---|---|---|
| | | POWER (Kwatts) | PRESSURE (mTorr) | GAS FLOW (sccm) |
| 44 (METAL 1) | CHROMIUM (Cr) | 5 | 1.5 | ARGON = 100 |
| 54 (METAL 2) | CHROMIUM (Cr) | 5 | 1.5 | ARGON = 100<br>NITROGEN = 25 |
| 52 (BUFFER) | ALUMINIUM (Al) | 1.5 | 1.5 | ARGON = 100<br>NITROGEN = 25 |

FIG. 10b

FIELD EMISSION DISPLAY CATHODE ASSEMBLY WITH GATE BUFFER LAYER

CROSS REFERENCE TO RELATED APPLICATION

This application is a divisional of Ser. No. 08/775,964 filed on Jan. 3, 1997, now U.S. Pat. No. 6,015,323.

GOVERNMENT RIGHTS

This invention was made with government support under Contract No. DABT 63-93- C-0025 awarded by the Advanced Research Projects Agency (ARPA). The government has certain rights in this invention

BACKGROUND OF THE INVENTION

The present invention relates to an improvement in field emission display (FED) technology and, in particular, to a FED cathode assembly that substantially reduces or eliminates the occurrence of an adverse chemical reaction between a chromium gate electrode and an insulating (i.e., dielectric) oxide layer.

FIG. 1 illustrates a typical FED structure 10, which includes a cathode assembly 9 and an anode assembly 8 separated from each other by spacers 25. Cathode assembly 9 has a substrate or baseplate 12 with a base conductive layer 14 formed thereon, a resistive layer 15 (e.g., amorphous silicon) deposited on top of layer 14, and a plurality of conical, cold cathode emitters 16 formed on layer 15. Also formed on layer 15 is an electrically insulating (i.e., dielectric) layer 18 having a conductive layer located thereon, which forms gate electrode 20. This electrode, which is typically formed from metal, functions as an extraction grid to control the emission of electrons from emitters 16.

Anode assembly 8 has a transparent faceplate 22, a transparent conductive layer 23 over faceplate 22 and a black matrix grille (not shown) formed over layer 23 to define pixel regions. A cathodoluminescent coating (i.e., phosphor) 24 is deposited on these defined regions. This assembly is positioned a predetermined distance from emitters 16 using spacers 25. Typically, a vacuum exists between emitters 16 and anode 8.

A power supply 26 is electrically coupled to conductive layer 23, electrode 20 and conductive layer 14 for providing an electric field that causes emitters 16 to emit electrons and accelerate the electrons toward conductive layer 23. A vacuum in the space between baseplate 12 and anode 22 provides a relatively clear path for electrons emitted from emitters 16. The emitted electrons strike cathodoluminescent coating 24, which emits light to form a video image on a display screen created by anode 8.

FIG. 2 is a schematic diagram of a portion of the FED structure 10 shown in FIG. 1. In operation, electrons flow from the conductive layer 14 to an emitter 16 through resistor 32, which is formed by the resistive layer 15. This resistive layer is current limiting. Even in the case of a short circuit between emitter 16 and electrode 20, resistive layer 15 limits the flow of current, and thus the flow of electrons, through the circuit branch formed by conductive layer 14, resistive layer 15, and emitter 16.

Referring again to FIG. 2, an electric potential placed on gate electrode 20 (which functions as an extraction grid) pulls an electron emission stream from emitter 16. A second potential placed on layer 23 attracts the freed electrons, which accelerate toward this layer until they strike cathodoluminescent coating 24. Specific examples of FEDs are disclosed in the following U.S. patents, each of which is hereby incorporated by reference in its entirety for all purposes: U.S. Pat. Nos. 3,671,798, 3,970,887, 4,940,916, 5,151,061, 5,162,704, 5,212,426, 5,283,500, and 5,359,256.

Successful FED operation depends upon, among other things, a dependable gate electrode that is capable of consistent and prolonged operation. The formation of conventional gate electrodes is well known and described, for example, in the following U.S. patents, each of which is hereby incorporated by reference in its entirety for all purposes: U.S. Pat. Nos. 5,186,670, 5,299,331, 5,259,799 and 5,372,973.

Chromium metal is considered an ideal gate electrode in field emission displays. Although the electrical conductivity of chromium (Cr) is less than aluminum and the noble metals, critical parameters such as chemical durability, adhesion to glass and nonreactivity with solutions such as "Piranha" (i.e., a 2:1 mixture of $H_2SO_4$ and $H_2O_2$, commonly used to remove organic contamination and strip photoresist) and hydrofluoric acid (an aqueous solution of HF commonly used to etch $SiO_2$) make chromium an attractive candidate for gate electrodes. In a conventional FED structure, such as shown in FIG. 1, electrodes formed from Cr layers (e.g., base conductive layer 14 and the conductive layer forming gate electrode 20) are sputter deposited to a thickness of approximately 200 nm. An insulating layer of $SiO_2$ located between these layers (e.g., dielectric layer 18) is deposited to a thickness of about 500 nm.

It has been observed that chromium used as a gate electrode (e.g., electrode 20) adversely reacts with deposited silicon dioxide ($SiO_2$; e.g., dielectric layer 18) upon application of an electrical potential between the gate electrode and a base conductive layer (e.g., layer 14), both in ambient and under vacuum conditions. Under ambient atmospheric pressure, the reaction occurs rapidly and results in a brown, bubbling reaction product at the surface of the chrome electrode. This reaction coincides with a rapid reduction in the breakdown voltage of the dielectric layer. Under vacuum conditions typical of an FED operating environment (i.e., about $1\times10^{-7}$ to $1\times10^{-8}$ Torr; referred to herein as "FED vacuum conditions"), no bubbling is observed on the chrome electrode, however, a gradual chemical transformation occurs at a site on the electrode where electrical contact is made with a probe tip (i.e., a standard tungsten probe tip commonly used for contacting structures during electrical measurements). Again, this reaction coincides with a gradual deterioration of the dielectric breakdown voltage.

Deterioration of dielectric breakdown voltage of a FED cathode assembly under FED vacuum conditions could lead to shorting between the Cr gate electrode and an associated base conductive layer, degradation in emission current of emitters (e.g., cold cathode emitters 16), reduction in brightness of an associated FED display and eventual failure of the FED unit. Accordingly, the very reliability of a FED unit is jeopardized by this phenomena.

From the above, it is seen that a method and apparatus is desired for substantially reducing or eliminating the occurrence of an adverse chemical reaction between a chromium gate electrode and an insulating (i.e., dielectric) layer that coincides with a deterioration of dielectric breakdown voltage in a FED cathode assembly.

SUMMARY OF THE INVENTION

A FED cathode assembly and method for making same that substantially reduces or eliminates the occurrence of an adverse chemical reaction between a chromium gate electrode and an insulating (i.e., dielectric) layer is provided. In one embodiment, the invention provides a cathode assembly that includes a layer of insulating material, a buffer layer located over the insulating layer and a layer of chromium located over the buffer layer. In another embodiment, an FED is provided that includes a baseplate, a first layer of conductive material located over the baseplate, a layer of insulating material located over the first layer of conductive material, a buffer layer located over the insulating material and a second layer of conductive material located over the buffer layer. In both embodiments, the buffer layer may be formed from copper, aluminum, silicon nitride or silicon (e.g., amorphous, polycrystalline or microcrystalline).

In yet another embodiment, a method for forming a cathode assembly is provided that includes the steps of forming a layer of insulating material over a first layer of conductive material, forming a buffer layer over the insulating layer and forming a second layer of conductive material over the buffer layer.

A further understanding of the nature and advantages of the invention may be realized by reference to the remaining portions of the specification and the drawings. In the drawings, like reference numbers indicate identical or functionally similar elements.

BRIEF DESCRIPTION OF THE DRAWINGS

FIG. 10*a* illustrates exemplary process parameters for plasma-enhanced chemical vapor deposition (PECVD);

FIG. 10*b* illustrates exemplary process parameters for dc magnetron sputtering;

DESCRIPTION OF SPECIFIC EMBODIMENTS

Figure 1:
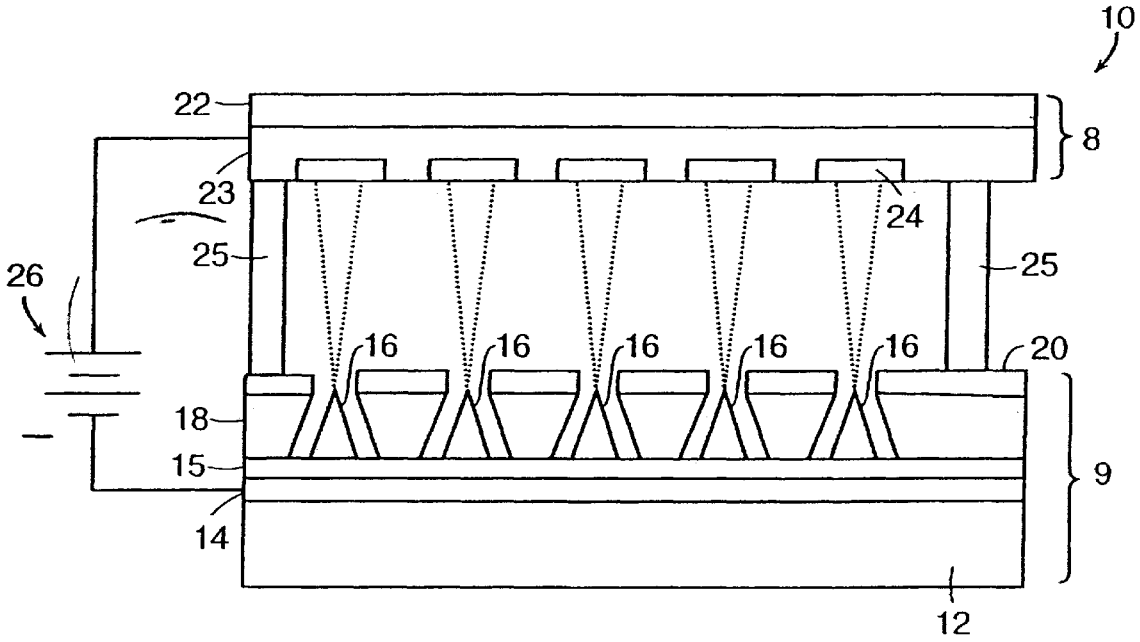
FIG. 1 PRIOR ART
FIG. 1 is a schematic vertical section of a cold cathode field emission display (FED)
Figure 2:
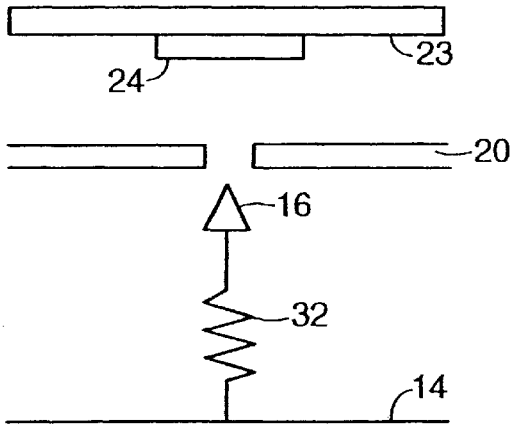
FIG. 2 PRIOR ART
FIG. 2 is an electrical schematic diagram of a typical FED configuration.

For purposes of the following discussion, electrode 20 and dielectric layer 18 in FED structure 10 (FIG. 1) are considered to be formed from Cr and $SiO_2$, respectively. In such a configuration, it has been determined that application of an electric potential (e.g., 20 to 200 V) under ambient conditions across layer 18 leads to vigorous bubbling at the surface of electrode 20 and subsequent formation of chromium oxides (predominantly $Cr_2O_3$, but also $CrO_3$) throughout electrode 20. (Although 20 to 200 V is suggested, any voltage level will produce similar results over time.) Due to the formation of such chromium oxides, there is a rapid reduction in the breakdown voltage of dielectric layer 18.

Figure 3:
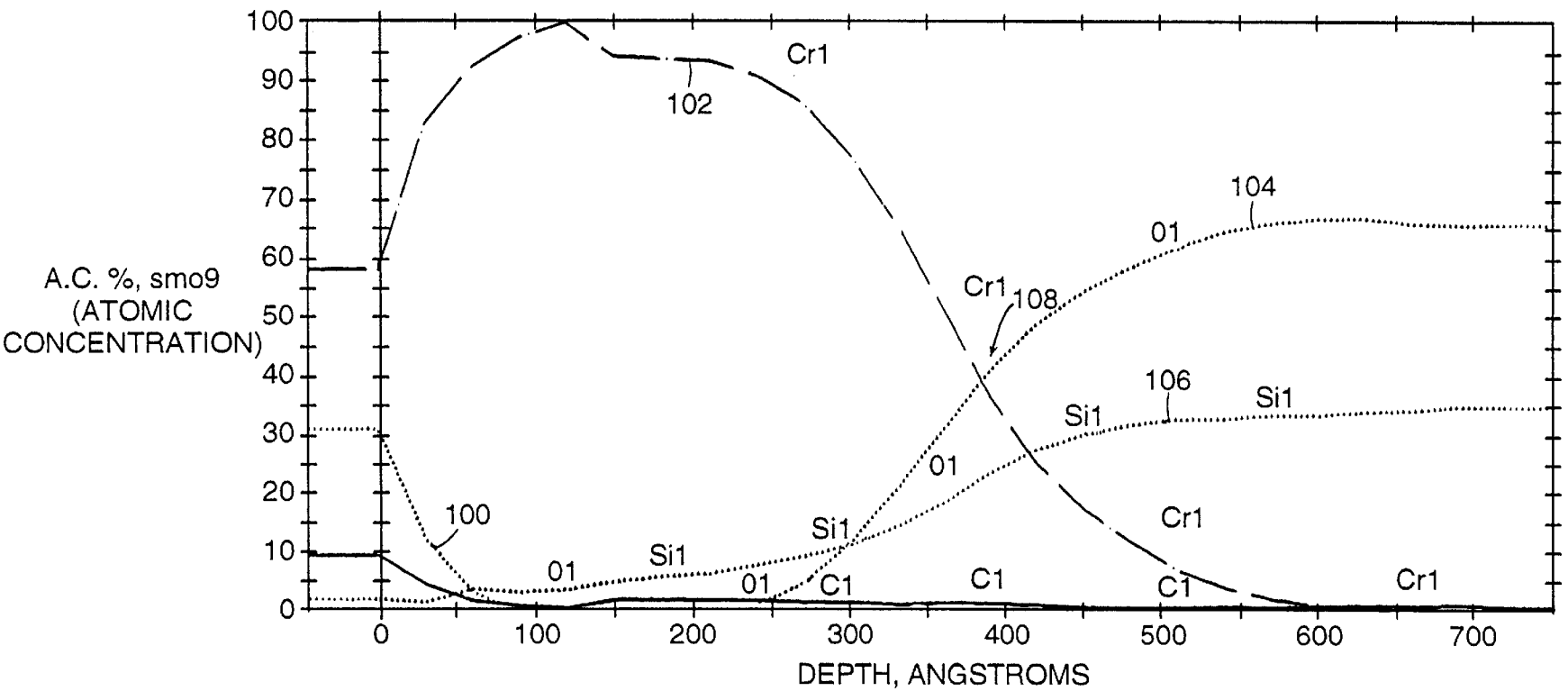
FIG. 3 is an x-ray photoelectron spectroscopy (XPS) depth profile of a portion of a test structure shown in FIG. 12 before voltage is applied.
Figure 4:
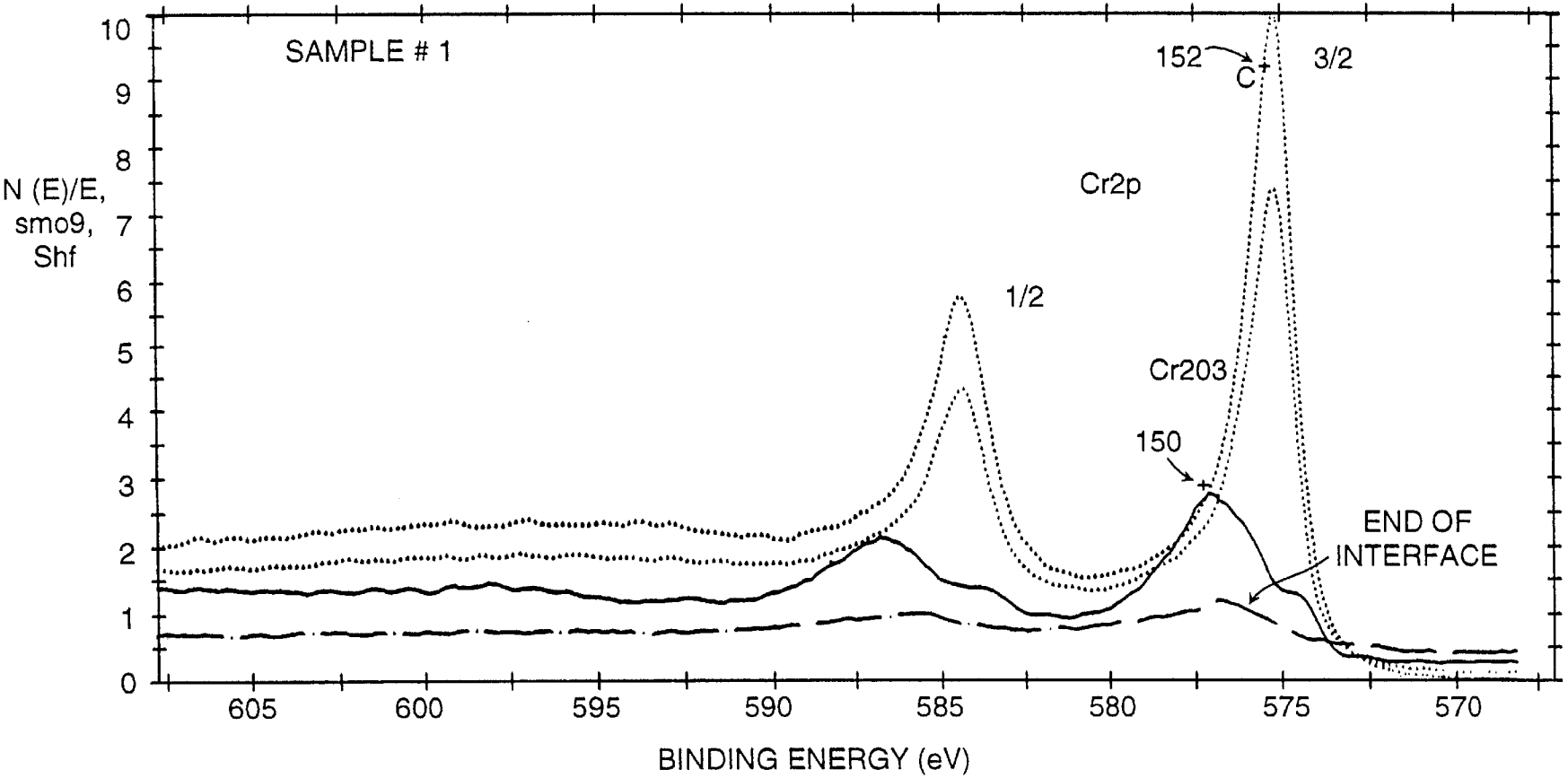
FIGS. 4 and 5 illustrate binding energy data of select elements of the test structure shown in FIG. 12 before voltage is applied.
Figure 5:
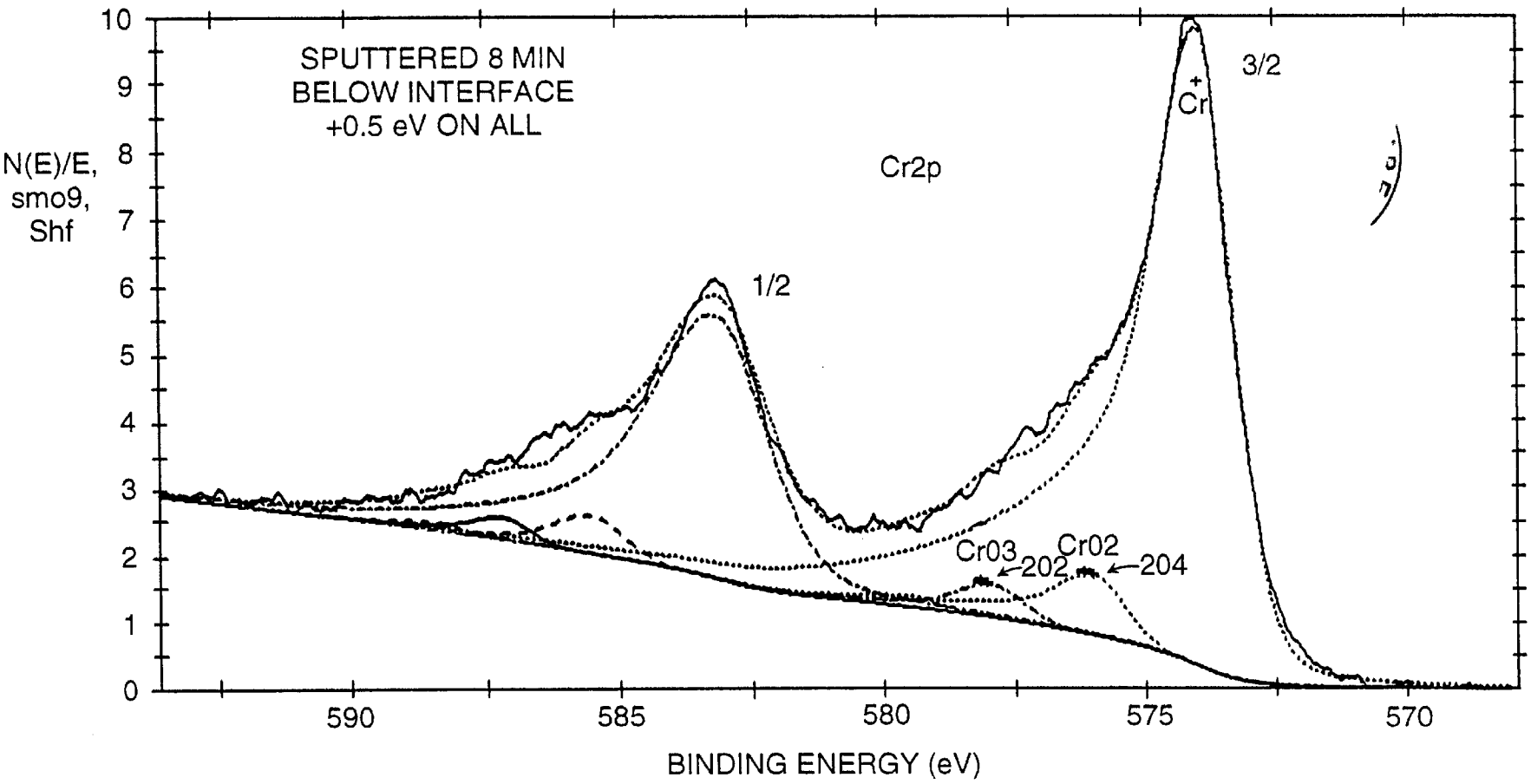
Figure 12:
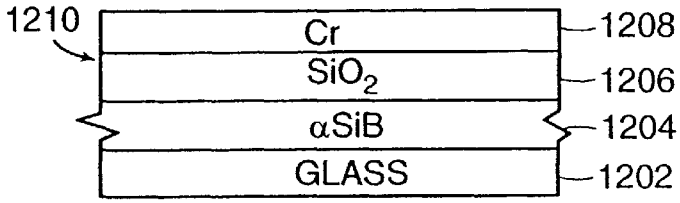
FIG. 12 is a schematic drawing of a portion of a test structure.

FIGS. 3–8 illustrate the change in composition of a chromium layer (such as electrode 20) resulting from an applied voltage under ambient (i.e., atmosphere) conditions. FIGS. 3–5 relate to a pre-voltage state while FIGS. 6–8 relate to a post-voltage state. More specifically, FIG. 3 shows x-ray photoelectron spectroscopy (XPS) data of a depth profile of a test structure from the top of a Cr layer to a contiguous $SiO_2$ layer. The test structure, a portion of which is shown in FIG. 12 (not drawn to scale), includes a first (i.e., bottom) layer of glass 1202, a second layer of B-doped amorphous silicon (ˆlaSiB) 1204 located atop the first layer, a third layer of $SiO_2$ 1206 located atop the second layer and a fourth (i.e., top) layer of Cr 1208 located atop the third layer. Cr layer 1208 is approximately 275 angstroms thick and contacts $SiO_2$ layer 1206 at interface 1210.

The composition of Cr layer 1208 and a portion of $SiO_2$ layer 1206 of the test structure is graphically illustrated in FIG. 3, which shows atomic concentration of constituent elements in relation to depth from the top (i.e., surface) of Cr layer 1208 (i.e., lines 100, 102, 104 and 106 represent atomic concentrations of $Cr_2O_3$, Cr, oxygen and silicon, respectively). The intersection of lines 102 and 104 at point 108 represents the interface 1210 between Cr layer 1208 and $SiO_2$ layer 1206 of FIG. 12.

As shown by line 100 of FIG. 3, a native oxide is present to a depth of about 50 angstroms from the top of the Cr layer 1208. This oxide is identified as $Cr_2O_3$ (based upon measured binding energy, as shown at data point 150 in FIG. 4.) The bulk of the Cr layer 1208 is identified as pure chromium (based again upon measured binding energy, and shown by data point 152 of FIG. 4.) This pure chromium persists until reaching interface 1210 (FIG. 12) between the Cr and $SiO_2$ layers. At this interface, 6% of the chromium detected is identified as chromium VI ($CrO_3$) and chromium IV ($CrO_2$) oxides (oxidation states +6 and +4, respectively), as shown at binding energy data points 202 and 204, respectively, in FIG. 5.

Figure 6:
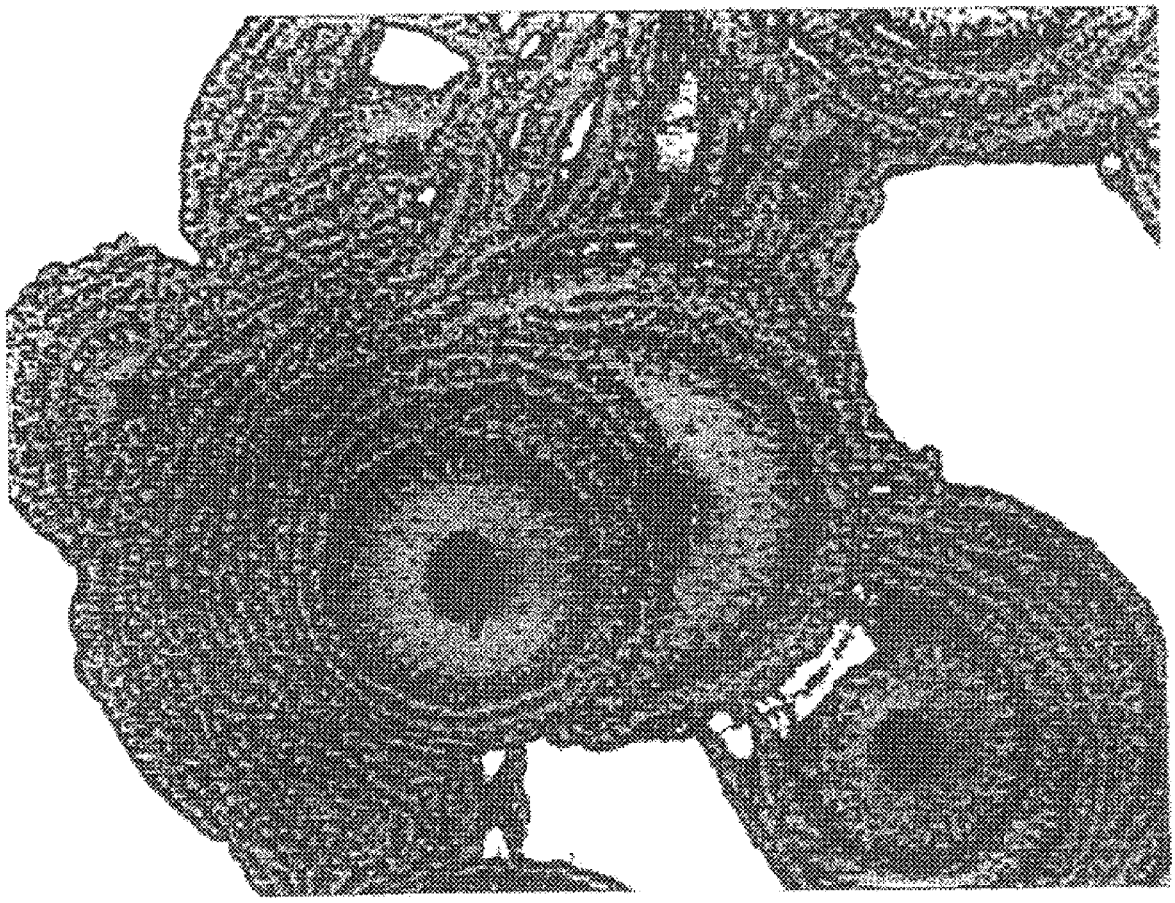
FIG. 6 is an optical micrograph of a Cr surface with an underlying $SiO_2$ layer after voltage is applied.

FIG. 6 shows an optical micrograph of the surface of a Cr layer (such as layer 1208) after a voltage of about 30–40 V is applied across an underlying $SiO_2$ layer (such as layer 1206) for about 1–2 minutes and an adverse chemical reaction has occurred. As can be seen in the figure, liquid formation nucleates at different points until the entire area of chrome metal is enveloped. During the liquid formation, if a voltage is present across an underlying $SiO_2$ layer, it gives rise to a bubbling effect and the near-total elimination of the chromium metal.

Figure 7:
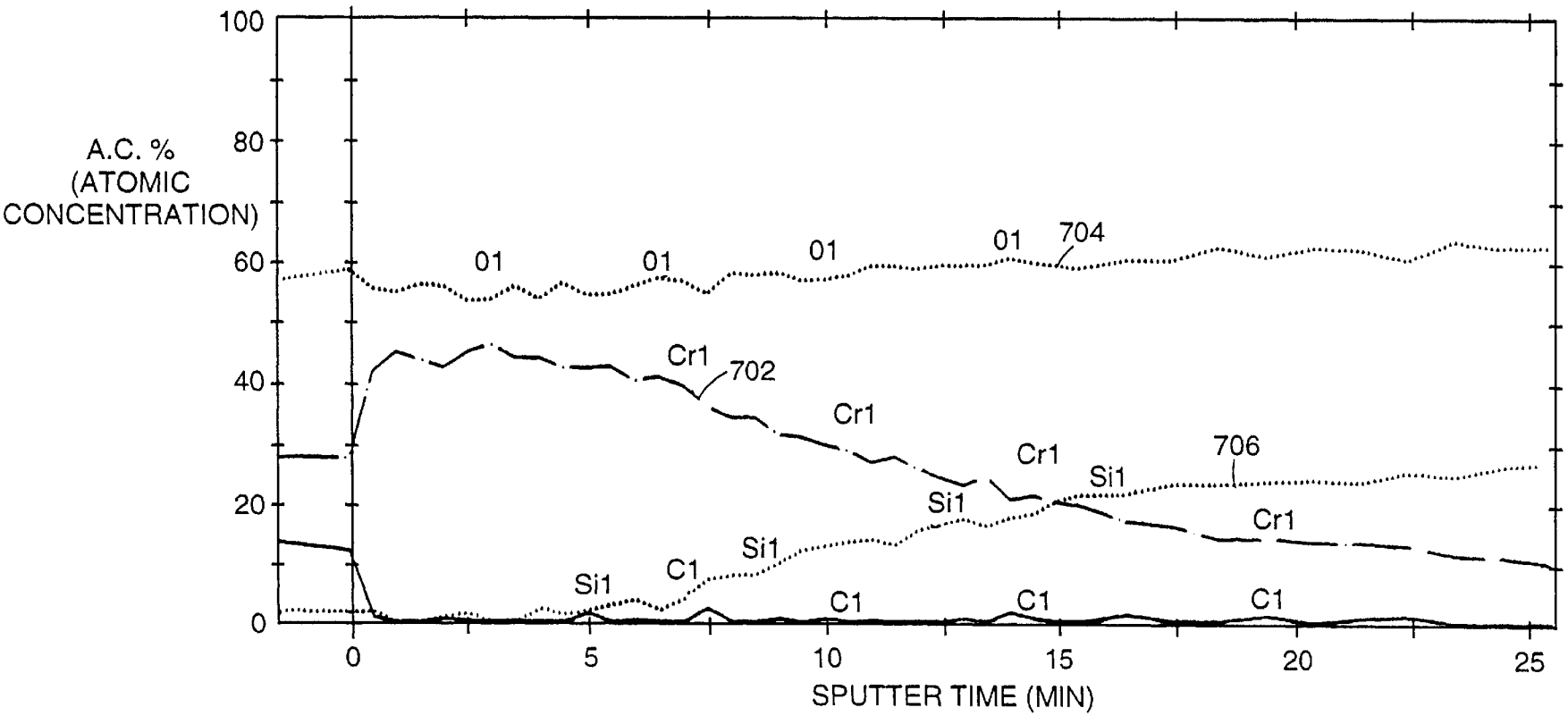
FIG. 7 is a depth profile of a portion of the test structure of FIG. 12 after voltage is applied.
Figure 8:
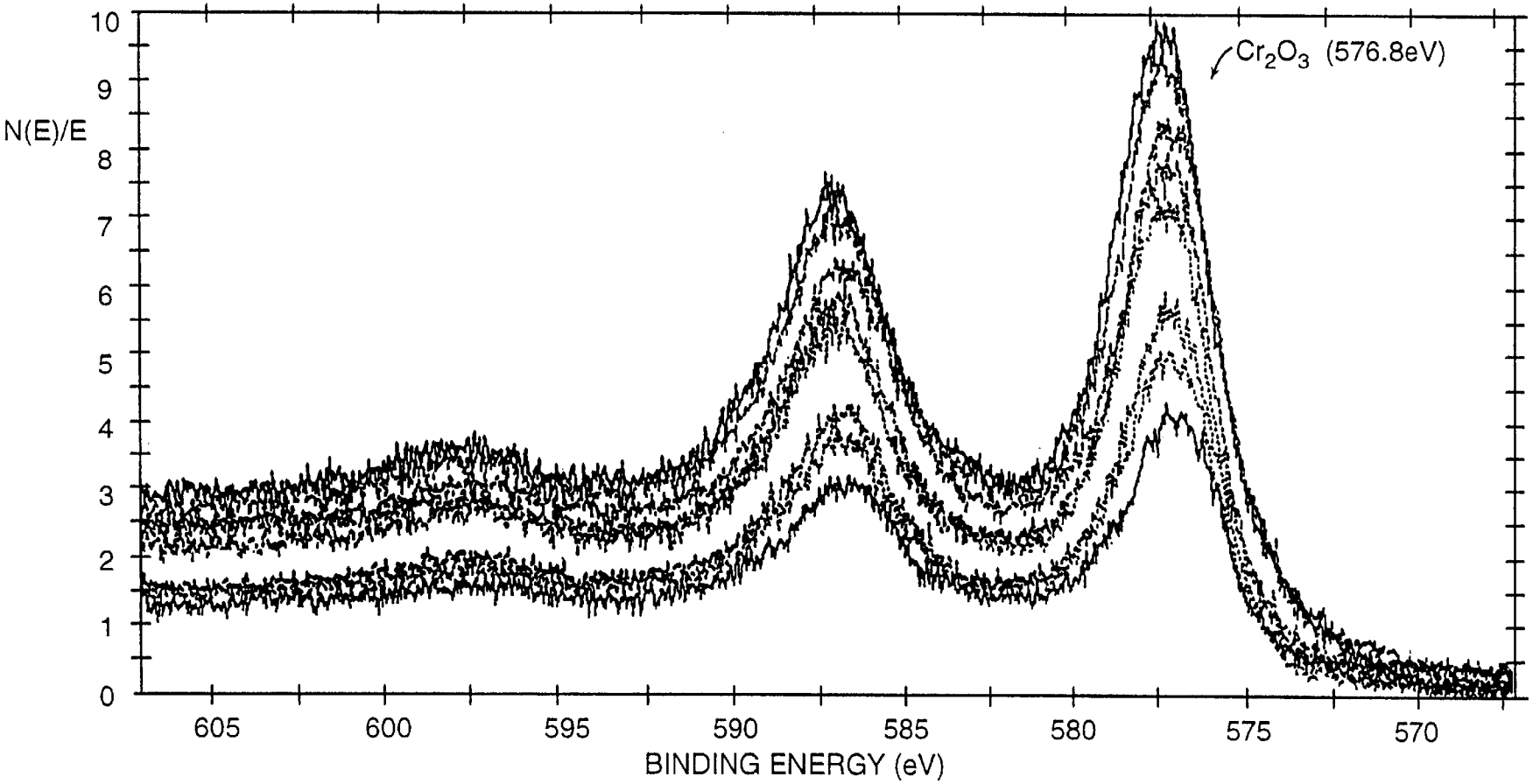
FIG. 8 illustrates binding energy data of a select element of the test structure of FIG. 12 after voltage is applied.

FIG. 7 is a depth profile of a portion of the test structure of FIG. 12 after voltage is applied. Referring to FIG. 7, line 704 represents oxygen that is bonded to chromium (represented by line 702) in at least layer 1208 of the test structure of FIG. 12. The chromium oxide formed by the constituent elements of lines 704 and 702 is identified through binding energy as chromium oxide ($Cr_2O_3$), as shown in FIG. 8. (Such oxide has a theoretical binding energy of 576.95 eV which, as shown in FIG. 8, is nearly identical to the measured value of approximately 576.8 eV.) Chromium oxide is present throughout Cr layer 1208 (indicated by lines 702 and 704); such presence coincides with the deterioration of dielectric breakdown voltage.

In contrast to operating under ambient conditions, when a potential of about 200 V is continuously applied under FED vacuum conditions (i.e., the operating environment of a FED) to Cr electrode 20 (FIG. 1) for about six to forty-eight hours, there is a gradual adverse chemical reaction at a probe site on electrode 20 (i.e., a location on electrode 20 where electrical contact is made with a standard tungsten probe tip) which results in a decrease in the breakdown voltage of dielectric layer 18. The reaction at the affected site on and just below the surface (about 30 angstroms) of electrode 20 is found to be associated with chromium oxides ($Cr_{23}$ and $CrO_2$), sodium and silicon dioxide ($SiO_2$) rather than pure chromium. Although slower, the adverse chemical reaction observed in the Cr electrode under FED vacuum conditions produces essentially the same result as the reaction under ambient conditions: deterioration of dielectric breakdown voltage.

Figure 9:
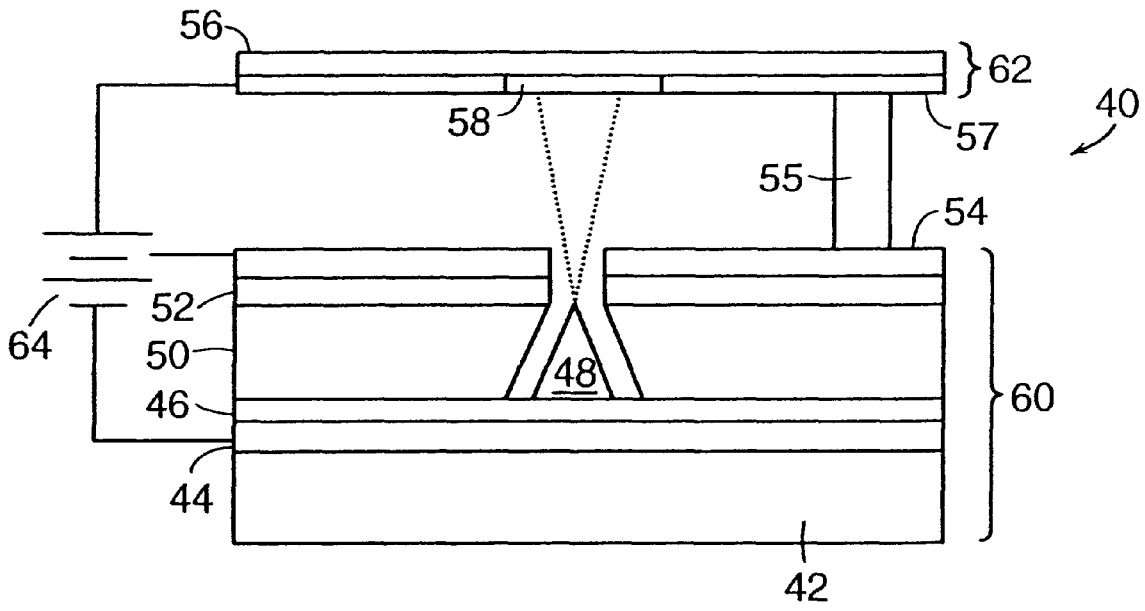
FIG. 9 is a schematic vertical section of a cold cathode FED constructed according to the principles of the invention.

FIG. 9 is a cross-sectional view of a portion of a cold cathode FED structure 40 constructed to substantially reduce or eliminate altogether the foregoing adverse chemical reaction between a Cr electrode and $SiO_2$ layer. Structure 40 includes a cathode assembly 60 and an anode assembly 62, which are separated from each other by spacers 55 (only one is shown for clarity). Cathode assembly 60 has a substrate or baseplate 42 constructed from, for example, soda-lime glass. (Other glasses may be used, such as Corning glass.) A conductive layer 44 is formed over baseplate 42, a resistive layer 46 is deposited over layer 44 and one or more cold cathode emitters 48 are formed on layer 46 (only one is shown for clarity). Also formed on resistive layer 46 is a dielectric layer 50. Cavities are formed in layer 50 to accommodate emitters 48.

According to the invention, a buffer layer 52 is formed on top of insulating dielectric layer 50 such that a chromium gate electrode 54 (forming an extraction grid) is not in direct contact with dielectric layer 50. Buffer layer 52 may be formed from copper, aluminum, silicon nitride ($Si_3N_4$) and doped or undoped amorphous, poly, or microcrystalline silicon.

Anode assembly 62 has a transparent faceplate 56, a transparent conductive layer 57 formed over faceplate 56 and a black matrix (not shown) formed over layer 57 to define pixel regions. A cathodoluminescent coating (i.e., phosphor) 58 is deposited on these defined regions (only one is shown for clarity). This assembly is spaced at a predetermined distance from emitters 48 via spacers 55 (only one is shown), and a vacuum exists between these emitters and anode 62. Exemplary materials for use in one embodiment of the invention are identified in Table 1.

TABLE 1

| Element | Material |
|---|---|
| substrate 56 | soda-lime glass |
| conductive layer 57 | indium tin oxide (ITO) |
| coating 58 | cathodoluminescent phosphors |
| black matrix | cobalt oxide |
| electrode 54 | chromium |
| buffer 52 | metal (copper, aluminum), silicon nitride or silicon (amorphous, poly or microcrystalline) |
| insulating layer 50 | silicon dioxide |
| emitter 48 | amorphous silicon |
| resistive layer 46 | amorphous silicon |
| conductive layer 44 | metal (e.g., chromium) |
| substrate 42 | glass |

In an alternative embodiment, resistive layer 46 may be replaced with an external resistor (used for current limiting) located in series (electrically) between power supply 64 and conductive layer 44.

Referring again to FIG. 9, cathode assembly 60 of FED structure 40 may be constructed using conventional semiconductor fabrication processes, as described below. Fabrication steps are illustrated in chart 1100 of FIG. 11 and exemplary process parameters are provided in FIGS. 10*a* and 10*b*.

Figure 11:
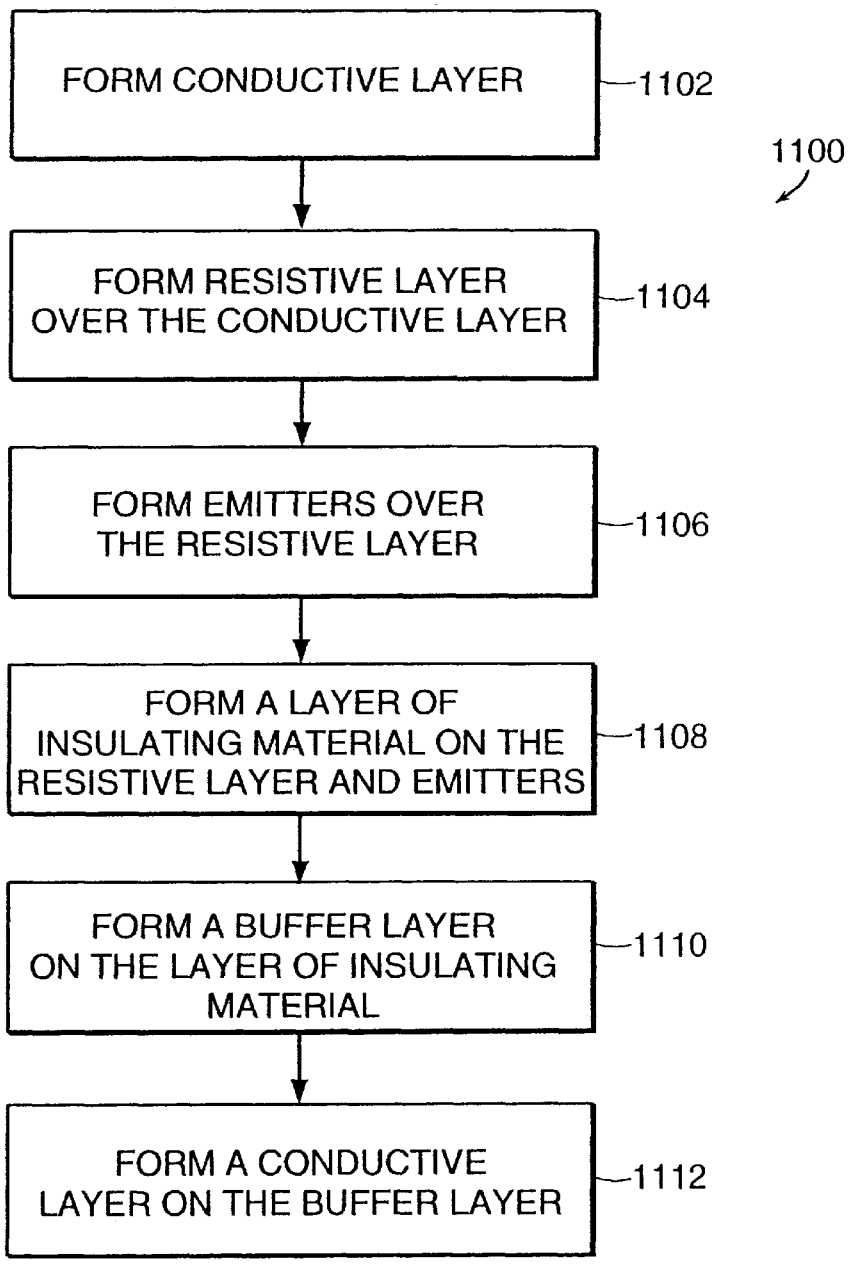
FIG. 11 is a flow chart of a method for constructing a cathode assembly of the cold cathode FED of FIG. 9 according to the principles of the invention.

Initially, a conductive layer 44 (FIG. 9), for example, is formed on baseplate 42 pursuant to block 1102 of FIG. 11. This layer may be constructed from chromium and formed by dc magnetron sputtering (i.e., dc sputtering within an applied magnetic field, a process well known to those having ordinary skill in the art), as indicated in FIG. 10*b*. Resistive layer 46 is next formed, over layer 44, pursuant to block 1104 in FIG. 11, using plasma enhanced chemical vapor deposition (PECVD) as indicated in FIG. 10*a*. Emitters 48 are then formed in accordance with block 1106 of FIG. 11, by any known method, such as disclosed in U.S. Pat. No. 5,186,670. The emitter tip layer may be formed from amorphous silicon using PECVD, as indicated in FIG. 10*a*.

Pursuant to block 1108 in FIG. 11, insulating layer 50 is next formed on resistive layer 46 and emitters 48. This step may be carried out through PECVD of $SiO_2$, as indicated in FIG. 10*a*. In block 1110, buffer layer 52 is formed on top of insulating layer 50. If made from metal (e.g., copper or aluminum), buffer layer 52 may be formed by dc magnetron sputtering pursuant to FIG. 10*b*. Alternatively, if made from silicon nitride or silicon (e.g., amorphous, poly or microcrystalline), this layer may be formed by PECVD pursuant to FIG. 10*a*. Finally, a conductive layer that creates electrode 54 is formed on buffer layer 52, pursuant to block 1112. This layer may be formed by dc magnetron sputtering in accordance with FIG. 10*b*.

The foregoing process steps (and process parameters provided in FIGS. 10*a* and 10*b*) are merely exemplary. One having ordinary skill in the art would recognize that many conventional semiconductor fabrication processes may be used to construct cathode assembly 60 in FIG. 9. For example, dc sputtering (i.e., without an applied magnetic field), diode sputtering, triode sputtering, electron beam evaporation and thermal evaporation may be used instead of dc magnetron sputtering. Similarly, chemical vapor deposition (CVD), hot-wire deposition and CVD hot-wire deposition may be used instead of PECVD. Preferably, layer 52 is constructed from silicon nitride using PECVD. Moreover, as is well known, the silicon-based layers identified in FIG. 10*a* (i.e., layers 46, 48, 50 and 52) will include a minority percentage of hydrogen (i.e., no more than about 25% for silicon nitride and about 20% for the remainder).

To compensate for the presence of buffer layer 52 (i.e., to maintain the same proximal relationship between gate electrode 54 and tips of emitters 48), the thickness of insulating layer 50 may be reduced by approximately the thickness of layer 52. Alternatively, the height of emitters 48 may be increased by the same amount to maintain the same emitter tip to extraction grid spacing. Preferred approximate layer thickness, approximate emitter height and material used to create FED structure 40 is provided in Table 2.

TABLE 2

| Element | Thickness/Height | Material |
|---|---|---|
| faceplate 56 | 0.5 mm | Corning 1734 glass |
| conductive layer 57 | 1000 angstroms | ITO |
| coating 58 | 5^1 mm | phosphor |
| black matrix | 3–4^1 mm | cobalt oxide |
| electrode | 2000 angstroms | chromium |
| buffer 52 | 1000 angstroms | silicon nitride |
| insulating layer 50 | 7000 angstroms | silicon dioxide |
| emitter 48 | 10000 angstroms | ^1aSiP |
| resistive layer 46 | 5000 angstroms | ^1aSiB |
| conductive layer 44 | 2000 angstroms | chromium |
| baseplate 42 | 3 mm | soda-lime glass |

Referring to Table 2, ^1aSiP and ^1aSiB represent P-doped and B-doped amorphous silicon, respectively. When buffer layer 52 is formed from silicon nitride ($Si_3N_4$), thickness may range from about 500 to about 4000 angstroms, and the preferred thickness, as noted in Table 2, is about 1000 angstroms. In addition, when layer 52 is formed from silicon (e.g., microcrystalline, amorphous, or polycrystalline), thickness may range from about 1000 to about 5000 angstroms, and the preferred thickness is about 3000 angstroms (in which case, insulating layer 50 may be reduced to about 5000 angstroms thick if using the dimensions of Table 2). Finally, when layer 52 is formed from metal (e.g., copper or aluminum), thickness may range from about 500 to about 2000 angstroms, and the preferred thickness is about 1000 angstroms (in which case, the dimensions of Table 2 remain unchanged).

A power supply 64 is electrically coupled to conductive layer 44, electrode 54 and conductive layer 57 for providing an electric field that causes emitters 48 to emit electrons to regions 58. Typically, supply 64 grounds conductive layer 44 and applies a DC voltage of approximately 2000 to 6000 V to anode 62 and approximately 100 V to gate electrode 54. As a result, electrons flow from conductive layer 44, through resistive layer 46, and out from the tips of emitters 48. The emitted electrons strike cathodoluminescent coating regions 58, which generate visible light or luminance.

As noted above with respect to FED structure 10 in FIG. 1, applying a potential between substrate conductive layer 14 and Cr electrode 20 in cathode assembly 9 may cause failure of gate electrode 20 due to an adverse chemical reaction. However, in accordance with the invention, application of a potential between substrate conductive layer 44 and Cr electrode 54 in FIG. 9 will not cause failure of electrode 54 due to the presence of buffer layer 52. In this context, experimental tests conducted on Cr gate electrodes buffered by layers composed of aluminum, polysilicon or silicon nitride resulted in no measurable adverse chemical reaction at the surface or interface of the electrodes with applied voltages as high as approximately 300 V to 400 V.

The invention has now been described in terms of the foregoing embodiment with variations. Modifications and substitutions will now be apparent to persons of ordinary skill in the art. Accordingly, it is not intended that the invention be limited except as provided by the appended claims.

What is claimed is:

1. An assembly comprising:

a substrate;

a plurality of emitters over the substrate, a layer of insulating material over the substrate and laterally near the emitters;

a buffer layer including metal located over and in direct contact with the layer of insulating material; and a first layer conductive material, different from the buffer layer, located over and in direct contact with the buffer layer, the conductive material including chromium.

2. The assembly of claim 1, wherein the buffer layer is formed from a material selected from the group consisting of copper and aluminum.

3. The assembly of claim 2, wherein the buffer layer is formed from copper.

4. The assembly of claim 2, wherein the buffer layer is formed from aluminum.

5. The assembly of claim 1, further comprising a second layer of conductive material over the substrate and under the emitters.

6. The assembly of claim 5, further comprising a power source coupled to the first and second layers of conductive material, the power source holding the first layer of conductive material at a voltage higher than that of the second layer of conductive material.

7. The assembly of claim 1, wherein the buffer layer is 500 to 4000 Angstroms thick.

8. The assembly of claim 1, wherein the layer of insulating material is an oxide layer.

9. The assembly of claim 8, wherein the buffer layer has sufficient thickness to substantially prevent the formation of chromium oxides.

10. An assembly comprising;

a substrate;

a plurality of emitters over the substrate layer;

a layer of insulating material over the substrate and laterally near the emitters;

a buffer layer including a nitride and located over and in direct contact with the layer of insulating material; and a first layer of conductive material, different from the buffer layer, located over and in direct contact with said buffer layer, the conductive material including chromium.

11. The assembly of claim 10, wherein the buffer layer is made of silicon nitride.

12. The assembly of claim 10, further comprising a second layer of conductive material over the substrate and under the emitters.

13. The assembly of claim 10, wherein the insulating layer is an oxide.

14. The assembly of claim 10, wherein the buffer layer is 500 to 4000 Angstroms thick.

15. The assembly of claim 10, wherein the insulating layer is an oxide, and the buffer layer has sufficient thickness to substantially prevent the formation of chromium oxides when the display is in operation.

16. The assembly of claim 15, wherein the buffer layer includes silicon nitride.

* * * * *